US012668962B2

(12) United States Patent
Patton

(10) Patent No.: US 12,668,962 B2
(45) Date of Patent: Jun. 30, 2026

(54) HAIR CAPTURE DEVICES

(71) Applicant: Jamel Patton, Boca Raton, FL (US)

(72) Inventor: Jamel Patton, Boca Raton, FL (US)

( * ) Notice: Subject to any disclaimer, the term of this patent is extended or adjusted under 35 U.S.C. 154(b) by 124 days.

(21) Appl. No.: 18/389,396

(22) Filed: Nov. 14, 2023

(65) Prior Publication Data

US 2024/0084569 A1 Mar. 14, 2024

Related U.S. Application Data

(63) Continuation of application No. 17/317,850, filed on May 11, 2021, now Pat. No. 11,851,863.

(51) Int. Cl.
*E03C 1/264* (2006.01)

(52) U.S. Cl.
CPC ..... *E03C 1/264* (2013.01)

(58) Field of Classification Search
CPC ..... A47K 7/024; E03C 1/264; A46B 15/0097; A45D 44/16
USPC ..... 4/605; 15/160
See application file for complete search history.

(56) References Cited

U.S. PATENT DOCUMENTS

| | | | | | |
|---|---|---|---|---|---|
| D280,868 | S | * | 10/1985 | Russell | D4/118 |
| D363,378 | S | * | 10/1995 | Fredricks | D4/130 |
| 5,983,433 | A | * | 11/1999 | Chapman | A46B 11/002 4/606 |
| D455,867 | S | * | 4/2002 | Pratt | D28/63 |
| 8,402,979 | B2 | * | 3/2013 | McHugh | A45D 19/00 132/114 |
| D797,996 | S | * | 9/2017 | Wade | D28/63 |
| 2017/0142931 | A1 | * | 5/2017 | Michaelson | A01K 13/002 |
| 2018/0064233 | A1 | * | 3/2018 | Riley | A46B 17/02 |

* cited by examiner

*Primary Examiner* — Christine J Skubinna

(57) ABSTRACT

A loose hair capture or entrapment device designed to be especially effective in showers is disclosed. The device easily and safely captures and retains loose hair, which can be later readily removed and disposed. The device is meant to provide a means for preventing loose hair from falling into and clogging shower and tub drains. The device has a plurality of substantially opposing flexible pillars with a space or gap separating the opposing pillar ends. The plurality of opposing pillars may be tilted or angled in one direction such that by swiping one's hand or finger in a direction opposite to the pillar tilt reduces the gap dimension and tends to trap loose hair, while swiping one's hand in the direction of the pillar tilt increase the gap dimension and allows the loose hair to be removed for proper disposal.

15 Claims, 5 Drawing Sheets

HAIR CAPTURE DEVICES

CROSS-REFERENCE TO RELATED APPLICATIONS

This application claims priority to U.S. patent application Ser. No. 17/317,850, filed on 11 May 2021, now allowed and to be issued, and which is incorporated herein by reference as if set forth in full.

BACKGROUND OF THE INVENTION

When washing one's hair, often the loose hair attaches to the hands of the person washing his or her hair. Many individuals with long hair may then store their loose hair on the shower wall to be collected later. However, if the loose hair is rinsed off during a shower, it then often ends up in the drain, a drain blockage generally results.

Outside of direct drain protection in the form of strainers, blockers or wet brushes, few inventions appear to have been created or created to prevent hair from entering the shower drain. Without such a strainer, when showering, loose hair will flow directly into and down the drain. This will likely result in a clogged and backed up shower drain. If a strainer, screen, or blocker is installed at the drain, the hair will likely be caught, but this results in the need for repetitive cleaning to prevent clogging. An individual may also incorporate a wet brush designed to be used on wet hair during their shower or bath. The wet brush will collect loose hair before it is directed into and down the drain and is made of a base with protruding flexible bristles.

Different mechanisms have been created to address this issue of loose hair in one's hands, and the potential for such hair being rinsed off and ending up in the shower drain. As described above, such devices have generally been strainer or filter devices attached to or over the shower drain. While these devices will typically catch most loose hair, these devices also catch the loose hair at the drain, which results in the drain backing up anyway. Moreover, such devices require the user to clean the device, which often can be a dirty and messy task.

Other device designs have been created to allow for collection of loose hair from one's hands. Such prior art designs include, by way of example, U.S. Pat. No. 10,765,198, for a Hair Removal Device, by Watne et al; U.S. Pat. No. 10,791,819 for a Loose Strand Retainer, by Caccamise, and U.S. Pat. No. 9,549,611 for a Shower Caddy, by Bocanegra.

In Watne et al., a hair removal device is disclosed that may be mounted to a wall. The device has an assembly of spines or tentacles projecting outward from the wall and disposed to form a plurality of finger rows between the assembly of spines. While Watne et al. teaches a device that can be used to collect loose hair from a user's hand or fingers, the Watne et al. device is essentially one-sided and requires the user to swipe his or her hand multiple times to remove loose hair. Moreover, the Watne et al. device does not provide for an easy means to remove the loose hair that is caught within the spines.

Similar to Watne et al., the Caccamise loose strand retainer device provides for elements of a single base configured for receiving and retaining loose strands, and an attachment means connected to the single base to allow for attaching the retainer device to a support surface. The Caccamise retainer device is one-sided and would require multiple swipes of the user's hand to remove the loose strands to the single base element. Moreover, there is no easy process for removal and cleaning of the loose strands from the retainer device.

As disclosed in Bocanegra, a shower caddy is shown that it may be hung from the shower head. The Bocanegra device has a hair screen (62) on a lowermost shelf. In use, the loose hair on one's hands and fingers are transferred to a panel by touching the panel, and then the water overspray during showering causes the hair to slide down the panel and become trapped in the hair screen. The screen can then be removed from the shelf for disposal of the collected hair. As disclosed and shown, it does not appear that loose hair in one's hand or fingers will be caught or attached to any panel in the Bocanegra device.

Each of these patents disclose particular designs and devices for collecting loose hair or strands, but none provide a comprehensive solution for the need to easily, and in one motion, collect loose hair from one's hand or fingers, and then in another single motion allow for collection and removal of the collected loose hair.

What is needed is an apparatus for use by individuals with longer hair that allows the user to easily remove loose hair from the user's hands, in a single motion or swipe, and retains the loose hair until the user wishes to easily remove and dispose of the collected and retained loose hair. The use of such a device within a shower, or next to a sink would be preferred, but is not necessary. Such a device does not appear to have been created or used upon a review of the relevant prior art.

BRIEF SUMMARY OF DESCRIBED EMBODIMENTS

The above noted problems inadequately or incompletely resolved by the prior art are addressed and resolved by the present invention. The present invention is a device made to capture or collect loose hair in place while showering for later disposal. The problem solved by the invention is to prevent hair from entering the drain. Examples and certain embodiments of the present invention are summarized below.

In one embodiment, there is disclosed a loose hair capture and retention device, comprising a base section, at least two substantially opposing side sections attached to the base section, a plurality of opposing flexible pillars attached to the side sections such that distal ends of the plurality of opposing flexible pillars may be separated by a pillar end gap, whereby by swiping in a first direction through the pillar end gap results in loose hair being captured and retained in the device; and whereby by swiping in a direction opposite to the first direction through the pillar end gap results in the captured loose hair being released and removed from the device.

In another embodiment, there is disclosed a loose hair capture and retention device, comprising a base section, at least two substantially opposing side sections attached to the base section, a plurality of opposing flexible pillars attached to the side sections such that distal ends of the plurality of opposing flexible pillars may be separated by a pillar end gap, whereby by swiping in a first direction through the pillar end gap results in loose hair being captured and retained in the device; and whereby by swiping in a direction opposite to the first direction through the pillar end gap results in the captured loose hair being released and removed from the device, and wherein said plurality of opposing flexible pillars are angled opposite to said first direction.

In a further aspect, there is disclosed a loose hair capture and retention device, comprising a base section, at least two substantially opposing side sections attached to the base section, a plurality of opposing flexible pillars attached to the side sections such that distal ends of the plurality of opposing flexible pillars may be separated by a pillar end gap, whereby by swiping in a first direction through the pillar end gap results in loose hair being captured and retained in the device; and whereby by swiping in a direction opposite to the first direction through the pillar end gap results in the captured loose hair being released and removed from the device, and wherein said base section and at least two substantially opposing side form a substantially rectangular shape.

In a further embodiment, there is disclosed a loose hair capture and retention device, comprising a base section, at least two substantially opposing side sections attached to the base section, a plurality of opposing flexible pillars attached to the side sections such that distal ends of the plurality of opposing flexible pillars may be separated by a pillar end gap, whereby by swiping in a first direction through the pillar end gap results in loose hair being captured and retained in the device; and whereby by swiping in a direction opposite to the first direction through the pillar end gap results in the captured loose hair being released and removed from the device, and wherein said base section and at least two substantially opposing side form a substantially cylindrical shape.

In still another embodiment, a loose hair capture and retention device, comprising a base section, at least two substantially opposing side sections attached to the base section, a plurality of opposing flexible pillars attached to the side sections such that distal ends of the plurality of opposing flexible pillars may be separated by a pillar end gap, whereby by swiping in a first direction through the pillar end gap results in loose hair being captured and retained in the device; and whereby by swiping in a direction opposite to the first direction through the pillar end gap results in the captured loose hair being released and removed from the device, and wherein said at least two substantially opposing side sections are attached to said base section with an articulating hinge providing for increasing and decreasing of said pillar end gap.

BRIEF DESCRIPTION OF THE DRAWINGS

For the purposes of illustrating the invention, the attached drawings show certain aspects and embodiments that are presently preferred. However, it should be understood that the invention is not limited to the precise elements, configurations, sizing, shapes, as shown in the accompanying drawings, but rather is further disclosed and claimed according to the attached claims.

DETAILED DESCRIPTION OF CERTAIN EMBODIMENTS

The hair capture and retention device is a unique and innovative design encompassing a body section or sections and flexible pillars or teeth such that the pillars are positioned to be opposing each other in various patterns. The pillar ends are separated from each other to create a pillar gap. The hair capture and retention device 100 is designed to be installed on the wall or another support structure in a shower stall. A user is able to collect loose hair within the pillars of the hair capture device 100 by swiping or guiding a finger or hand within the pillar gap. In order to clean the loose hair captured and retained in the device 100, the user can pinch or swipe the captured hair in the opposite direction from the direction used to capture the loose hair in the device.

Figure 1:
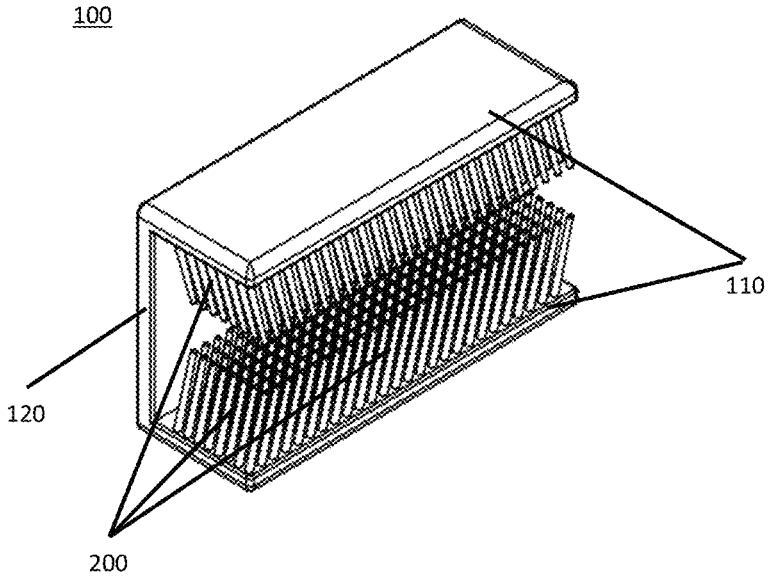
FIG. 1 is a front perspective view of an embodiment of the hair capture device shown in a rectilinear configuration.
Figure 2:
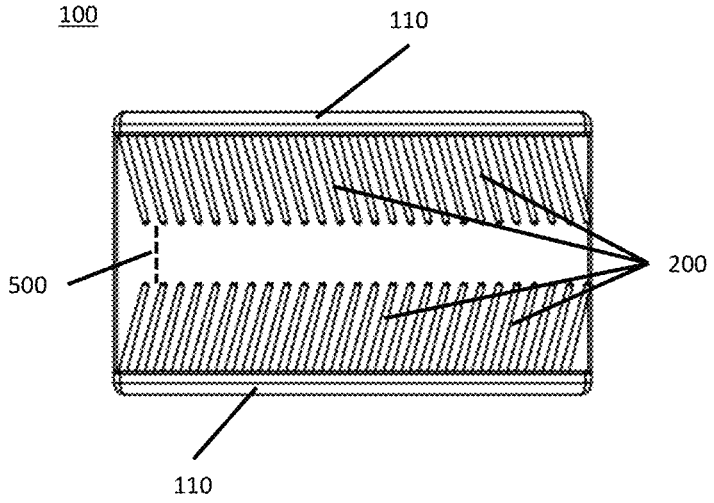
FIG. 2 is a front view of an embodiment of the hair capture device shown in a rectilinear configuration.

In one preferred embodiment of the inventive device, shown in FIGS. 1 and 2, the primary elements of the hair capture device 100 are a base section 120 and two side sections 110, along with a plurality of flexible pillars or teeth 200. As shown, the base section and side sections are joined to form a configuration such that the pillars 200 as attached to the side sections 110, and possibly base section 120, are substantially opposing each other. The pillars may be separated by a pillar end gap 500, as shown in FIG. 2. As described, the pillar end gap 500 allows the user to swipe or move his or hand finger or hand through the hair capture device 100 such that the loose hair is then captured by the pillars and removed from the user's finger or hand.

In one embodiment, as shown in FIGS. 1 and 2, the pillars 200 may be angled or tilted in one consistent direction. Through implementation of such a pillar tilt configuration, the hair capture device is more effective because as the user moves his or her finger in a direction opposite to the direction of the pillar tilt, the flexible pillars 200 bend and reduce the dimension of the pillar end gap 500, and thereby are more effective at capturing the loose hair. And accordingly, when seeking to remove the captured hair from the device 100, the user is able to move his or her finger or hand in the same direction as the pillar tilt, and the flexible pillars 200 then bend away from the swiping direction and increase the dimension of the pillar end gap 500, and thereby allowing for easy removal of the captured hair strands from the device.

The pillar tilt may be within the approximate range of 3 degrees to 45 degrees off of a perpendicular orientation to the side section 110 to which the pillar is attached.

By way of example for the configuration and embodiment shown in FIG. 2, the user may swipe his or her finger or hand from right to left to capture loose hair within the pillars 200 and within the hair capture device 100. To remove or release the captured loose hair from the device 100, the user may swipe his or her finger or hand from left to right to bend the pillars 200 towards the right and increasing the pillar end gap 500.

Figure 3:
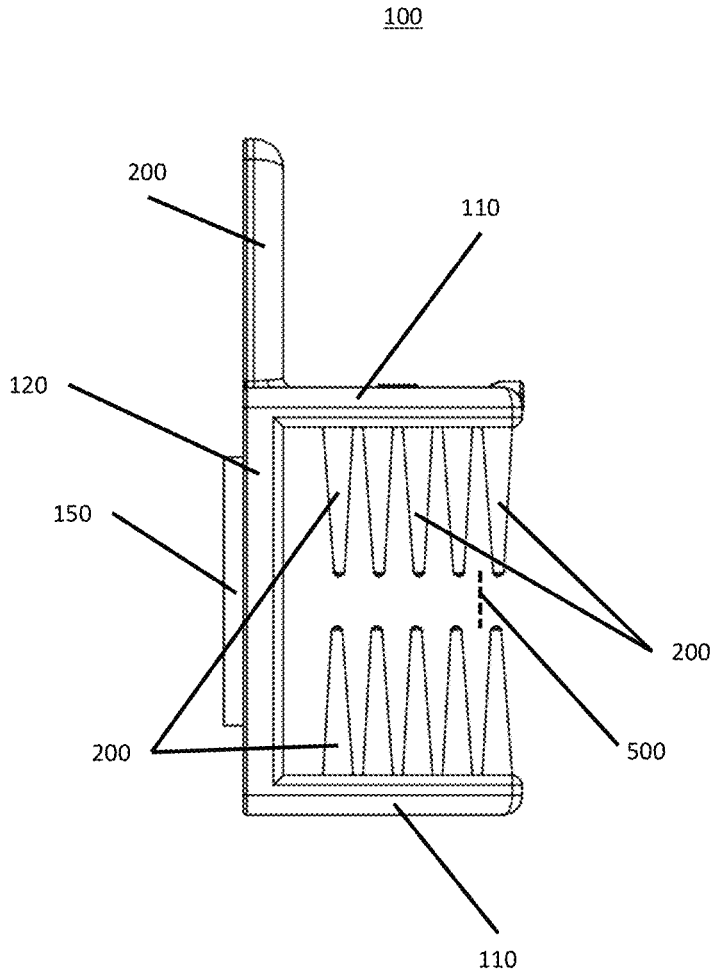
FIG. 3 is a side view of an embodiment of the hair capture device shown in a rectilinear configuration and with an ornamental feature.

In another, but similar embodiment, shown in FIG. 3, a side view of the hair capture device 100 is shown. This configuration similarly includes a base section 120, two side sections 110 and a plurality of pillars or teeth 200 attached to the side sections such that the pillar ends oppose each other and are separated by a pillar end gap 500. As described above, the hair capture device is designed for use where users wash their hair, including for example in a shower. As shown in FIG. 3, the hair capture device 100 may incorporate an adhesive element 150 that allows for the device 100 to be securely attached to a shower wall or other rigid support element within or next to a shower. An additional element, being an ornamental element or feature 300 is also shown, in a side view, in FIG. 3.

Figure 4:
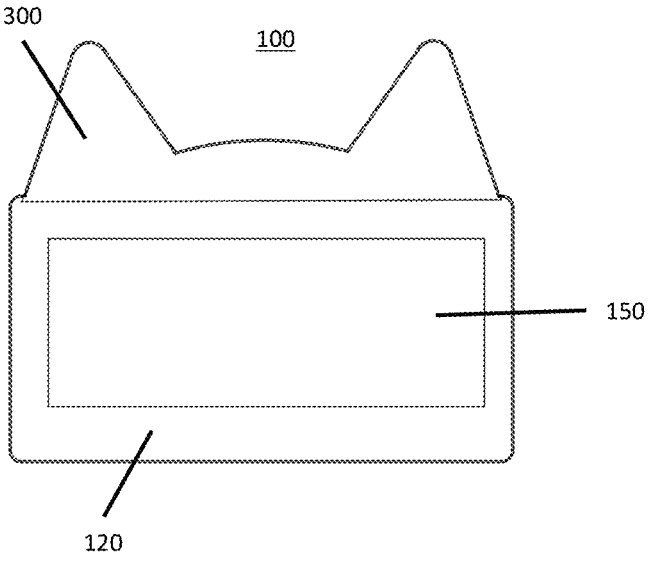
FIG. 4 is a back view of an embodiment of the hair capture device shown in a rectilinear configuration and with an ornamental feature.
Figure 5:
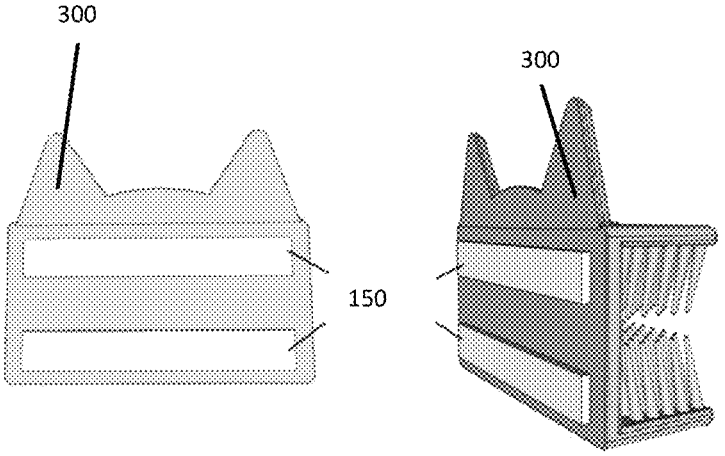
FIG. 5 shows a further back view and perspective back view of an embodiment of the hair capture device shown in a rectilinear configuration.

Different examples of adhesive elements 150 attached to the back of the base section 120 are shown in FIGS. 4 and 5. Also shown, in different views and perspectives are an example of the ornamental elements 300 that may be attached or formed as part of the base section 110. The "cat ears" shown in FIGS. 4 and 5 are but one of many different type of ornamental elements 300 that may be incorporated as part of the hair capture device 100 and are merely for aesthetic and enjoyment purposes.

Figure 6:
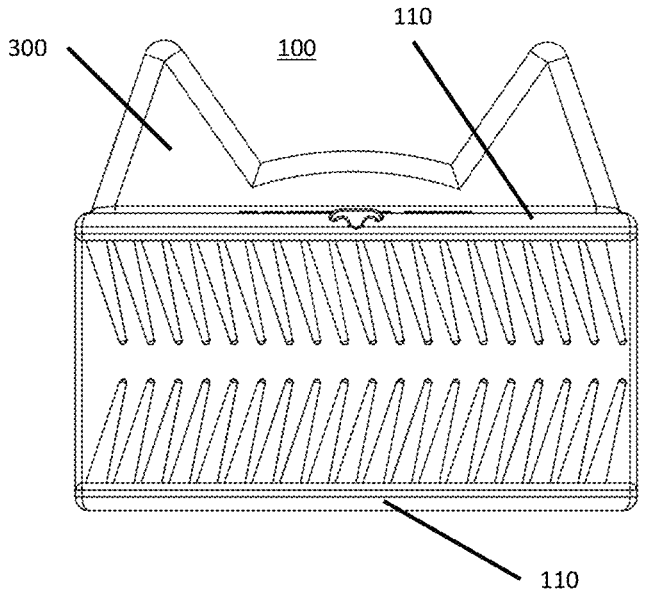
FIG. 6 is a front view of an embodiment of the hair capture device shown in a rectilinear configuration and with an ornamental cat feature.
Figure 7:
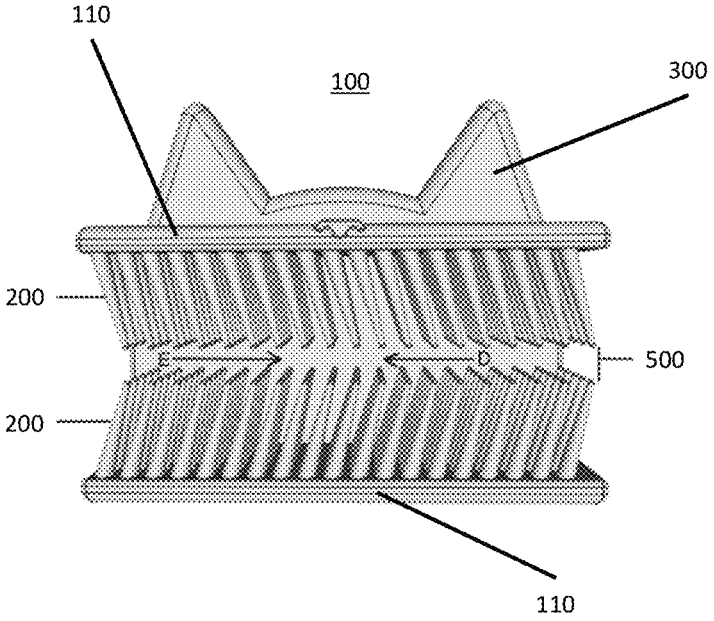
FIG. 7 is a further front view of an embodiment of the hair capture device shown in a rectilinear configuration and with an ornamental cat feature, and illustrating use and operation of the hair capture device.
Figure 8:
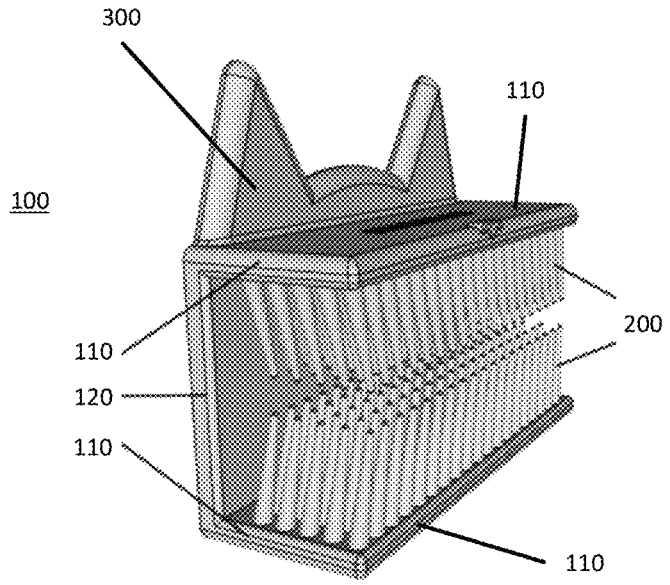
FIG. 8 is a frontal side view of another embodiment of the hair capture device shown in a rectilinear configuration with an ornamental cat feature.

Further views of the hair capture device 100, shown in a "shower cat" ornamental configuration are shown in FIGS. 6 and 7 in frontal views, and from a side perspective view in FIG. 8. FIG. 7 illustrates the usage of the "shower cat" such that to trap or capture loose hair on one's finger or hand, the user can swipe his or her hand in the "D" direction, thereby bending the pillars 200 and decreasing the pillar end gap 500. To then clean and remove the trapped or captured hair from the "shower cat," the user can swipe his or her hand in the "E" direction, thereby bending the pillars 200 in the "E" direction and increasing the pillar end gap 500 to allow for easy removal of the loose hair from the device 100.

Although the above described embodiments are shown in the figures having a positive pillar end gap 500, in alternative embodiments, the pillar end gap 500 may be larger or smaller than shown. Indeed, in other equally effective embodiments, the pillar end gap 500 may be substantially zero in dimension with the pillar ends essentially touching, or the pillar end gap 500 may be negative such that the pillar ends overlap with opposing pillar ends.

Figure 9:
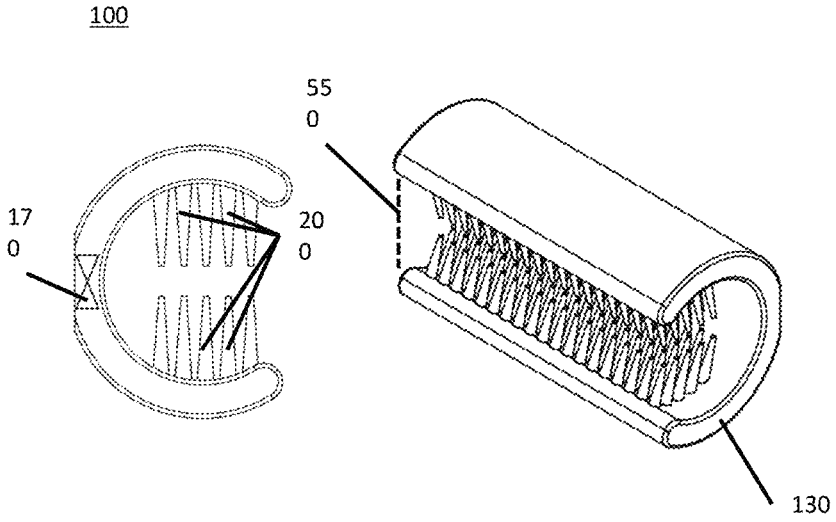
FIG. 9 is a perspective view of another embodiment of the hair capture device shown in a cylindrical configuration.

In another embodiment of the hair capture device 100, the body section may be configured in a non-rectilinear shape. As illustrated in FIG. 9, the body section 130 may be formed as a cylinder or in a cylindrical shape. In such a configuration, the pillars 200 are attached at one end to the interior of the body section 130 such that the other end of each pillar 200 substantially opposes other pillars 200. The cylindrical body section 130 incorporates a gap 550 that allows the user to swipe or move his or her finger or hand through the body gap 550.

The cylinder embodiment may further be manufactured with a pliable body section 130 such that the cylinder gap 550 widens when the user swipes his or her finger through the gap 550. In other alternative embodiments, the body section 130 may incorporate an articulating hinge or living hinge 170 that allows the cylinder gap 550 to open or widen as the user moves his or her finger through the gap 550.

A further embodiment incorporates side section 110 that are detachable from the base section 110 to allow for more complete cleaning of the pillars and removal of loose hair from the device 100. With such a configuration and embodiment, the removable side sections 110 may be separately soaked in a cleaning solution to further ensure a clean device.

In another embodiment (not shown), the hair capture device 100 may comprise a plurality of side sections 110. FIGS. 1 through 8 illustrate embodiments with two side sections 110, but in alternative configurations, the side sections shown may be divided into separate elements such that two, three, or four sub-sections are used to form a section side section 110.

Although the embodiments shown in FIGS. 1 through 8 show the pillars 200 aligned in rows or in a matrix-type configuration, in alternative embodiments, the pillars 200 may be positioned in non-aligned or offset configurations. Similarly, while the pillars 200 are shown in one embodiment having a tilt in one direction along the base section 120, in another embodiment (not shown), the pillars may be tilted away from the base section and pointed away from the support wall. Such a pillar 200 configuration and embodiment offer a further pillar arrangement to trap and collect loose hair.

With respect to the materials that the elements may be manufactured, it has been determined that thermoplastics are the most resilient for use in a water or humid environment such as a shower. The body sections 110, 120, 130 may be manufactured from any of a wide variety of thermoplastics including resilient thermoplastic materials, such as polyvinyl chloride (PVC), acrylonitrile butadiene styrene (ABS), polycarbonate, thermoplastic rubber (TPR), and/or thermoplastic elastomer (TPE). The pillars may be manufactured from similar materials where the pliability of the pillars is necessary. Alternatively, the pillars 200 may be manufactured from a silicone material.

While several preferred embodiments of the inventive hair capture device have been described and disclosed, in particular with reference to certain figures and drawings showing certain exemplary embodiments that relate to a particular shape, configuration, and size hair capture device, such configurations, designs, and embodiments are not to be construed as limiting the scope of the inventive device. For example, as described above, the hair capture device 100 may be made in different shapes, sizes, and configurations, and having varied ornamental features 300 provided as part of the base elements 110, 120. Further, although not specifically shown, but described above, the pillars 200 may be aligned as shown or offset from each other in alternative patterns. The pillars 200 may also be formed having different cross sections including circular or polygon cross sections. As described, the pillar end gap distance may be configured to be essentially zero or even with the pillar opposing ends overlapping each other. Moreover, as described, the pillars 200 may be tilted away from the base back element 120. All such alternate embodiments are believed to be within the scope of the inventive design and the below claims.

It will be recognized by those skilled in the art that other modifications, substitutions, and/or other applications are possible, and all such modifications, substitutions and applications are within the true scope and spirit of the present invention. It is likewise understood that the above disclosure and attached claims are intended to cover all such modifications, substitutions, and/or applications.

What I claim as my invention is:

1. A loose hair capture and retention device, comprising:

a unitary base section shaped substantially into an elongated C or U-configuration, and thereby having an interior surface and exterior surface;

a plurality of flexible pillars, attached to and extending away from said interior surface of said unitary base section;

whereby by swiping one's fingers through said plurality of flexible pillars results in loose hair being captured and retained within said plurality of flexible pillars.

2. The loose hair capture and retention device, as provided in claim 1, wherein at least approximately one half of said plurality of flexible pillars extending away from said interior surface of said unitary base section oppose each other.

3. The loose hair capture and retention device, as provided in claim 1, wherein said plurality of flexible pillars are attached to said interior surface of said unitary base section at a non-perpendicular angle.

4. The loose hair capture and retention device, as provided in claim 3, wherein said plurality of flexible pillars are angled at orientations from perpendicular within the range of approximately 3 degrees to 45 degrees.

5. The loose hair capture and retention device, as provided in claim 1, wherein distal ends of said plurality of flexible pillars overlap with distal ends of opposing flexible pillars.

6. The loose hair capture and retention device, as provided in claim 1, wherein said plurality of flexible pillars are detachable from said unitary base section.

7. The loose hair capture and retention device, as provided in claim 1, further comprising a flexible base plate to which said plurality of flexible pillars are attached, and wherein said flexible base plate is removably attached to said unitary base section.

8. The loose hair capture and retention device, as provided in claim 1, wherein said unitary base section forms a substantially cylindrical shape.

9. The loose hair capture and retention device, as provided in claim 1, wherein said unitary base section is made of a thermoplastic material.

10. The loose hair capture and retention device, as provided in claim 1, wherein said unitary base section is made of a thermoplastic rubber.

11. The loose hair capture and retention device, as provided in claim 1, wherein said plurality of flexible pillars are made of silicone.

12. The loose hair capture and retention device, as provided in claim 1, wherein said plurality of flexible pillars are made of thermoplastic elastomers.

13. The loose hair capture and retention device, as provided in claim 1, wherein said plurality of flexible pillars are made of thermoplastic rubber.

14. The loose hair capture and retention device, as provided in claim 1, where the plurality of flexible pillars have a circular cross-section.

15. The loose hair capture and retention device, as provided in claim 1, where the plurality of flexible pillars have a non-circular cross-section.

* * * * *